US012768148B2

(12) United States Patent
Bibard et al.

(10) Patent No.: US 12,768,148 B2
(45) Date of Patent: Oct. 20, 2026

(54) WORK IMPLEMENT POSITION CONTROL SYSTEM

(71) Applicant: Caterpillar Inc., Peoria, IL (US)

(72) Inventors: Alexis Bibard, Plaisance du Touch (FR); Jason S. Knowles, Bear Creek, NC (US); Steven C. Budde, Dunlap, IL (US); Jacob S. Rockhold, Fuquay Varina, NC (US)

(73) Assignee: Caterpillar Inc, Peoria, IL (US)

( * ) Notice: Subject to any disclaimer, the term of this patent is extended or adjusted under 35 U.S.C. 154(b) by 414 days.

(21) Appl. No.: 18/502,889

(22) Filed: Nov. 6, 2023

(65) Prior Publication Data

US 2025/0146257 A1 May 8, 2025

(51) Int. Cl.

| | |
|---|---|
| ***E02F 9/26*** | (2006.01) |
| ***E02F 3/76*** | (2006.01) |
| ***E02F 3/84*** | (2006.01) |
| ***E02F 5/32*** | (2006.01) |

(52) U.S. Cl.

CPC ..... *E02F 9/268* (2013.01); *E02F 3/7609* (2013.01); *E02F 3/844* (2013.01); *E02F 5/32* (2013.01)

(58) Field of Classification Search

None

See application file for complete search history.

(56) References Cited

U.S. PATENT DOCUMENTS

| | | | | |
|---|---|---|---|---|
| 3,662,220 | A * | 5/1972 | Riebs | H02H 3/093 361/97 |
| 5,685,377 | A | 11/1997 | Arstein et al. | |
| 7,797,860 | B2 | 9/2010 | Schoenmaker et al. | |
| 8,333,248 | B1 | 12/2012 | Sulzer | |
| 8,788,157 | B2 | 7/2014 | Shintani et al. | |
| 9,714,497 | B2 | 7/2017 | Hague | |
| 2005/0065689 | A1* | 3/2005 | Budde | E02F 3/845 701/50 |
| 2005/0137056 | A1* | 6/2005 | Yamada | F16H 61/061 477/156 |
| 2005/0221948 | A1* | 10/2005 | Iwamoto | F16H 59/72 477/34 |
| 2015/0198074 | A1* | 7/2015 | Mori | F01N 13/1805 60/286 |
| 2020/0002914 | A1 | 1/2020 | Yoshida et al. | |
| 2020/0359543 | A1* | 11/2020 | Dix | A01B 63/14 |
| 2022/0195704 | A1* | 6/2022 | Shimizu | E02F 9/2079 |
| 2022/0205225 | A1 | 6/2022 | Shiratani et al. | |

* cited by examiner

*Primary Examiner* — Daniel L Greene

(57) ABSTRACT

A control system includes a work implement positioning system for moving a work implement to a desired position. A sensor is associated with the work implement and configured to obtain position information of the work implement. An electronic controller is configured to initiate a timer when the work implement is placed in the predetermined position. The controller is further configured to upon expiration of the timer, cause the work implement positioning system to return the work implement to the desired position. The controller is further configured to determine that the work implement has returned to the desired position.

20 Claims, 3 Drawing Sheets

WORK IMPLEMENT POSITION CONTROL SYSTEM

TECHNICAL FIELD

This patent disclosure relates generally to a position control system for a work implement of a machine and, more particularly, to a system for maintaining a work implement of a machine in a predetermined position.

BACKGROUND

Many machines used in construction, agricultural and mining environments include an implement that is used to perform some sort of work. For example, machines can be used to perform a variety of tasks in a worksite including moving, digging, loosening and carrying materials. These machines may include ground engaging implements used to engage a work surface to move material and/or otherwise alter the work surface. Typically, movement of these implements are controlled by a machine operator via a hydraulic system.

Some machines have work implements that have to remain in a particular position such as an end-of-travel position (e.g., fully raised or fully closed) during certain operations. However, during the course of machine operations, the implement may move away from this position due to hydraulic leakage or external forces exerted on the implement. For example, a ripper attachment at the rear of a machine must remain in a fully raised position when not in use. If the ripper drifts down significantly from this raised position during non-ripper machine operations, the ripper can inadvertently damage the work surface or the ripper itself. To prevent this, the machine operator must recognize the change in position and manually operate the ripper or other implement back to the desired position. However, this requires the attention of the operator of the machine and can adversely affect the productivity of the operator and the machine. While it may be possible to add additional hardware to the hydraulic system, such as anti-drift valves or low-leakage hydraulic valves, to limit unintended movement of the implement, such hardware can add significant cost to the machine.

U.S. Pat. No. 5,685,377 ("the '377 patent"), assigned to the assignee of the present application, describes a system for controlling the movement of a ripper for a machine. A hydraulic system is provided that powers movement of the ripper. The control system includes an auto-return button that must be manually actuated by an operator. In response to being actuated by the machine operator, the auto-return button sends a signal to a controller that, in turn, directs the hydraulic system to automatically raise the ripper to a predetermined position. However, because the control system of the '377 patent requires operator intervention in the form of actuating the auto-return button, it fails to appreciate the problems of reduced operator and machine productivity associated with an operator having to monitor for, and make necessary adjustments in response to, unintended movement of the ripper.

SUMMARY

The disclosure describes, in one aspect, a control system for controlling a position of a work implement. The control system includes a work implement positioning system that is configured to be operated for moving the work implement. A sensor is associated with the work implement and configured to obtain position information of the work implement. A controller is configured to initiate, based on the position information of the work implement corresponding to a desired position of the work implement, a timer that is configured to indicate when a predetermined period of time has elapsed. Drifting of the work implement, away from the desired position to a current position, occurs without operation of the work implement positioning system. The controller is configured to cause, based on the timer indicating that the predetermined period of time has elapsed, the work implement positioning system to be operated to return the work implement from the current position to the desired position. The controller determines, based on the position information of the work implement, that the work implement has returned to the desired position.

In another aspect, the disclosure describes a machine including a machine frame, a work implement supported on the machine frame, and a work implement positioning system for moving the work implement to a desired position. A sensor is associated with the work implement and configured to obtain position information of the work implement. A controller is configured to initiate, based on the position information of the work implement corresponding to a desired position of the work implement, a timer that is configured to indicate when a predetermined period of time has elapsed. Drifting of the work implement, away from the desired position to a current position, occurs without operation of the work implement positioning system. The controller causes, based on the timer indicating that the predetermined period of time has elapsed, the work implement positioning system to be operated to return the work implement from the current position to the desired position. The controller determines, based on the position information of the work implement, that the work implement has returned to the desired position.

In yet another aspect, the disclosure describes a method for controlling movement of a work implement to a desired position. The method includes placing the work implement in the desired position and initiating, based on the work implement being placed in the desired position, a timer that is configured to indicate when a predetermined period of time has elapsed. Drifting of the work implement, away from the desired position to a current position, occurs without operation of the work implement positioning system. The method includes causing, based on the timer indicating that the predetermined period of time has elapsed, the work implement to be moved from the current position to the desired position. The timer is re-initiated upon determining that the work implement has returned to the desired position. Based on the timer, after being re-initiated, indicating that the predetermined period of time has elapsed, the work implement is caused to return to the desired position.

DETAILED DESCRIPTION

Figure 1:
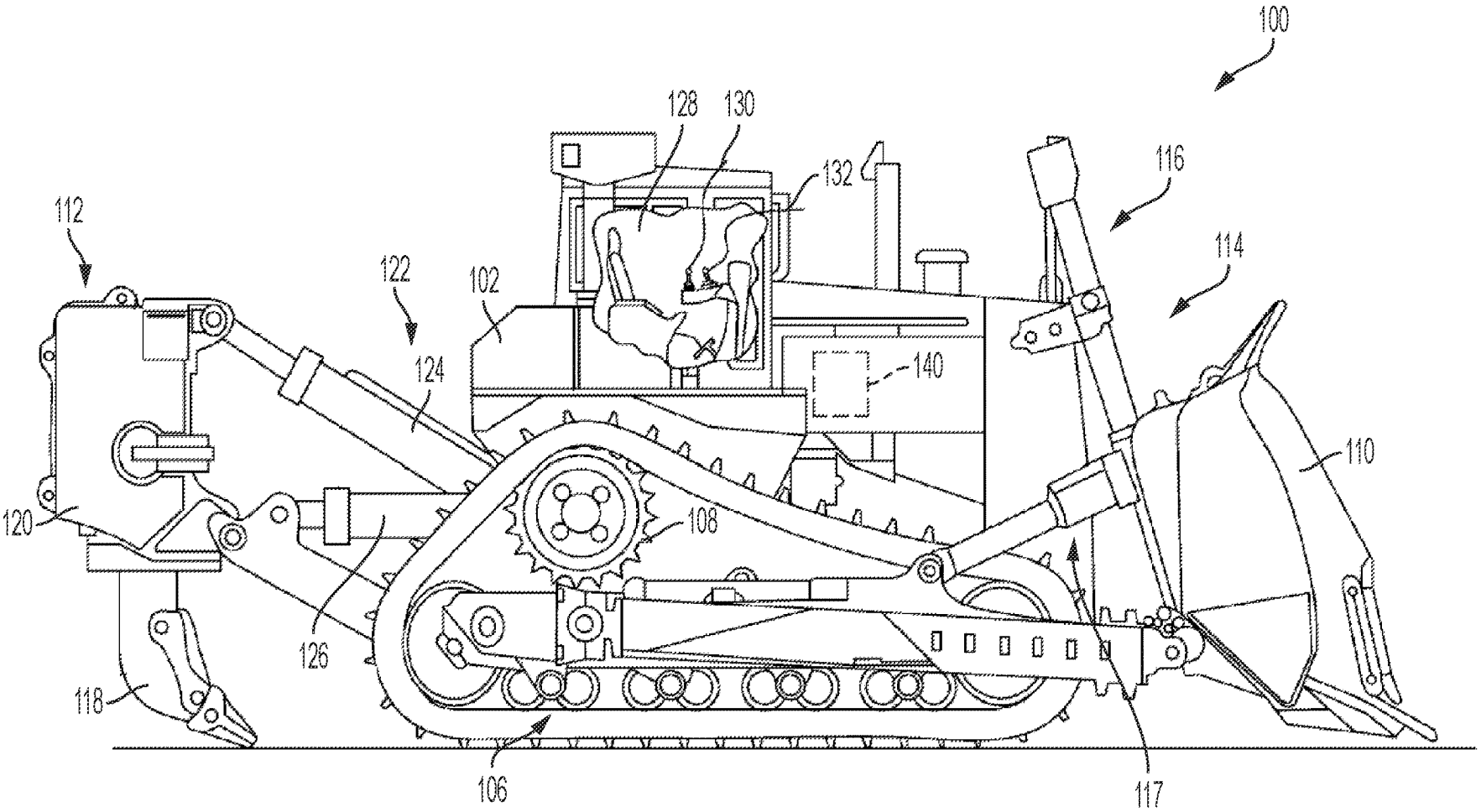
FIG. 1 is a side elevation view of an exemplary machine having a work implement and a work implement control system according to the present disclosure.

Now referring to the drawings, wherein whenever possible like reference numbers will refer to like elements, there is illustrated in FIG. 1 a machine 100 in the particular embodiment of a tractor for, in this case, loading, transporting, and delivering material about a worksite. However, while the present disclosure focuses on a machine 100 in the embodiment of a tractor, aspects of the disclosure may be applicable to a wide variety of other types of machines that perform some type of operation in association with an industry such as mining, construction, agriculture, forestry, waste management, transportation, material handling or the like. For example, the machine 100 may be a motor grader, loader, backhoe, excavator or any other type of work machine.

The machine 100 may traverse a work site to manipulate material beneath a work surface, e.g. transport, cultivate, dig, rip, and/or execute any other operation known in the art. The machine 100 may include a frame 102. A power source may be housed within an enclosure of the machine 100. The power source may be configured to produce mechanical power. The power source may be any type of internal combustion engine such as, for example, a diesel engine, a gasoline engine, or a gaseous fuel-powered engine. Further, the power source may be a non-engine type of power producing device such as, for example, a fuel cell, a battery, a motor, or another type of power source known in the art.

The machine 100 is provided with a traction device 106 for mobility. The traction device 106 may include tracks located on each side of the machine 100 (only one side shown) and operatively driven by one or more sprockets 108. The sprockets 108 may be operatively connected to the power source to receive power therefrom and drive the traction device 106. The traction device 106 may be hydraulically actuated, mechanically actuated, electronically actuated, or actuated in any other suitable manner. Movement of the traction device 106 may propel the machine 100 with respect to the work surface. Further, a relative motion of the tracks may cause a change in a direction of the steering of the machine 100. Alternatively, the traction device 106 may additionally or alternately include wheels, belts, or other traction devices.

To perform a work-related task during operation, the machine 100 can include one or more work implements. In the illustrated embodiment, the machine includes both a first implement comprising a blade 110 and a second element comprising a ripper 112. In this case, the blade 110 is supported on a front end of the machine 100 and is operatively associated with a blade positioning system 114. The blade positioning system 114 may include a lifting mechanism 116 that can vertically raise and lower the blade 110 with respect to a work surface. The lift mechanism 116 can include, for example, a hydraulic lift actuator and a mechanical linkage assembled from a plurality of rigid links connected by pivotal joints that can articulate and move with respect to each other to controllably displace or reposition the blade 110. The blade positioning system 114 may further include a tilt mechanism 117, including for example a hydraulic tilt actuator, to pivot the blade 110 relative to the lift mechanism 116. In other embodiments of machines, it will be appreciated that the front work implement 110 may be different than a blade such as, for example, a bucket, a fork, a drilling auger, and the like.

In the illustrated embodiment, the second implement, in this case the ripper 112, is provided at the rear end of the machine 100. The ripper 112 may include a shank 118 held in place by a mounting member 120. The shank 118 may penetrate the work surface to disturb or disrupt (i.e. rip) the material below the work surface. The shank 118 may be capable of movement relative to the mounting member 120. Further, the shank 118 may have several configurations relative to the mounting member 120. For example, the shank 118 may be moved to positions higher, lower, away from, or towards the frame 102 of the machine 100.

In an embodiment, the ripper 112 may be capable of movement via a ripper positioning system 122. More specifically, the ripper positioning system 122 may be configured to lift, lower, and may tilt the ripper 112 relative to the frame 102. In the illustrated embodiment, the ripper positioning system 122 includes a first hydraulic actuator 124 connected to the ripper 112 and configured to tilt the ripper 112 relative to the frame 102. The ripper positioning system 122 further includes a second hydraulic actuator 126 connected to the ripper 112 and configured to lift and lower the ripper 112 relative to the frame 102. It is contemplated that the second implement may alternatively include a plow, a tine, a cultivator, and/or any other task-performing device known in the art based on the application.

The first and second work implements, e.g., the blade 110 and ripper 112 may have an associated hydraulic system that provides pressurized hydraulic fluid to the blade positioning system 114 (including, for example, the lift and tilt mechanisms 116, 118) and the ripper positioning system 122 (including, for example, the first and second hydraulic actuators 124, 126). The hydraulic system may include a pump having an outlet port through which pressurized fluid is provided to the hydraulic system. The hydraulic system may also power other machine systems such as the brake, steering and lubrication systems. The hydraulic system may include one or more associated sensors including, in the illustrated embodiment, a hydraulic fluid temperature sensor 127 (see FIG. 2) that is configured to generate a signal indicative of the temperature of the hydraulic fluid in at least a portion of the hydraulic system.

The machine 100 may also include an operator station 128. An operator may control the operation of the blade 110 and the ripper 112 via input devices present within the operator station 128. The controls may include, but not limited be to, a work implement input device. In this case, the operator station includes a ripper input device 130 and a blade input device 132, although additional (or fewer) work implement input devices may be provided depending on the number and type of work implements provided on the machine. For example, the ripper input device 130 may allow the operator to set a height of the shank 118 of the ripper 112 above or below the work surface and/or set an angle of the shank 118 relative to the work surface. For example, the blade input device 132 may allow the operator to lift and tilt the blade. Although the ripper input device 130 and the blade input device 132 are shown as joysticks in the accompanying drawings, the controls may alternatively include push buttons, a touch screen control, voice control, steering wheel, switches and knobs. The operator station 128 may additionally include other controls such as, an acceleration pedal, a deceleration pedal or any other control devices known in the art. In other embodiments, the machine 100 may not have an operator station present on the machine itself and instead be configured for remote operation.

For controlling operation of the one or more work implements, the machine may include a control system embodied in a controller (e.g., an electronic controller 140, sometimes referred to as an electronic control module (ECM) or an electronic control unit (ECU)). The electronic controller 140 can be a programmable computing device and can include one or more microprocessors for executing software instructions and processing computer readable data. Examples of suitable microprocessors include programmable logic devices such as field programmable gate arrays ("FPGA"), dedicated or customized logic devices such as application specific integrated circuits ("ASIC"), gate arrays, a complex programmable logic device, or any other suitable type of circuitry or microchip. To store application software and data for the controlled operation of the electric powertrain, the electronic controller 140 can include a non-transitory computer readable and/or writeable memory, for example, read only memory ("ROM"), random access memory ("RAM"), EPROM memory, flash memory, or another more permanent storage medium like magnetic or optical storage. To interface and network with other operational systems on the machine 100, the electronic controller 140 can include an input/output interface to electronically send and receive non-transitory data and information. The input/output interface can be physically embodied as data ports, serial ports, parallel ports, USB ports, jacks, and the like to communicate via conductive wires, cables, optical fibers, or other communicative bus systems via any suitable communication protocol such as CAN Bus, WiFi, Bluetooth, or cellular communication standards. The electronic controller 140 may be associated with other software including any suitable instruction sets, programs, applications, routines, libraries, databases and the like, for carrying out its functions. Although in FIG. 2, the electronic controller 140 is illustrated as a single, discrete unit, in other embodiments, the electronic controller 140 and its functions may be distributed among a plurality of distinct and separate components, including various components and functionalities located onboard the machine 100 and/or at an off-board operator station.

Figure 2:
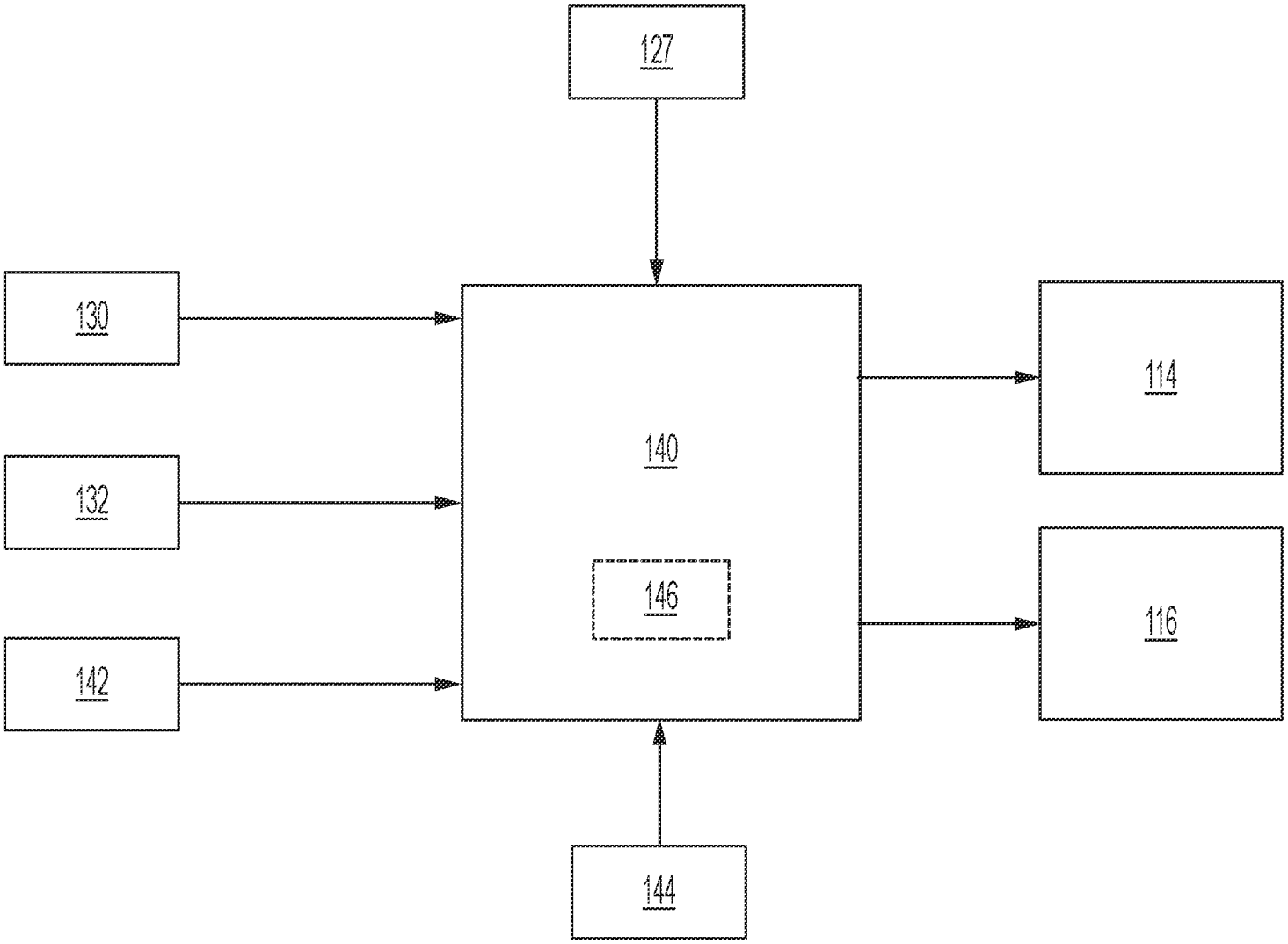
FIG. 2 is a schematic diagram of the work implement control system for the machine of FIG. 1.

For facilitating implementation of an operator's commands for the work implements, the ripper input device 130 and the blade input device 132 may be operatively connected to the electronic controller 140 as shown in FIG. 2. Based on signals from the input devices 130, 132, the electronic controller 140 may further be configured to communicate information regarding a desired movement or operation to the respective work implement. In this regard, the illustrated electronic controller 140 is in communication with the ripper positioning system 122 and the blade positioning system 114. Additionally, one or more sensors configured to generate a position signal indicative of a position of at least one work implement may be in communication with the electronic controller 140. In the illustrated embodiment the work implement sensors include a ripper sensor 142 and a blade sensor 144 both of which are also operatively connected to the electronic controller 140 as shown in FIG. 2. More specifically, the ripper sensor 142 may be configured to generate a position signal indicative of the position of the ripper 112 that is communicated to the electronic controller 140. Similarly, the blade sensor 144 may be configured to generate a position signal indicative of the position of the blade 110 that is communicated to the electronic controller 140. The ripper and blade sensors 142, 144 may include at least one of a position sensor, a pressure sensor, a pin sensor, a flow sensor, a limit switch or a rotary sensor. In one embodiment, the ripper sensor 142 may be associated with the first and second hydraulic actuators 124, 126 while the blade sensor 144 may be associated with the lift and tilt mechanisms 116, 117. In some embodiments, the one or more sensors may be conjured to provide a continuous indication of the position of the corresponding work implement while in other embodiments the one or more sensors may be configured to provide a signal only when the corresponding work implement is in one or more desired positions. In the illustrated embodiment, the hydraulic temperature sensor 127 is also in communication with the electronic controller. Although in FIG. 2 the hydraulic fluid temperature, ripper and blade sensors 127, 142, 144 are illustrated as single, discrete units, the respective sensor functions may be distributed among a plurality of distinct and separate sensor elements. Moreover, while the illustrated embodiment includes position sensors associated with both work implements, the present disclosure includes embodiments in which only one of the work implements has an associated position sensor.

The data lines of the electronic communications network between the electronic controller 140 and the hydraulic fluid temperature sensor 127, the ripper sensor 142, the blade sensor 144, the blade positioning system 114 and the ripper positioning system 122 are represented by lines in FIG. 2 and may be embodied as a CAN bus or similar protocols and may utilize conductive wires or fiber optics as the physical transmission media.

To help eliminate the need for an operator to monitor the position of one or more of the work implements when the work implement is to be held in a desired position for a prolonged period of time, the electronic controller 140 may be configured to periodically adjust the positioning of the work implement so as to automatically return the work implement from a current position to the desired position without the need for any operator intervention. In some embodiments, the desired position is a travel or idle position in which the work implement can be held when not in use. For example, with respect to the ripper 112 and the blade 110, the desired position may be a raised position. In the illustrated embodiment, the periodic, automatic return function is provided by the electronic controller 140 for both the ripper 112 and the blade 110. However, in other embodiments, the automatic return function may be implemented for only one of the work implements or for more than two work implements.

For facilitating the periodic automatic return function, the electronic controller 140 may be configured with a timer 146 as shown in FIG. 2. The timer 146 may be configured to initiate the automatic return function after the passage of a predetermined period of time. To this end, the timer 146 may count down (or count up) the predetermined period of time. Upon the passage of the predetermined period of time, the timer 146 may produce a timer expiration signal that directs the electronic controller to initiate movement of the ripper 112 and/or blade 110 into the desired position without the need for any operator intervention or even monitoring of the work implement position. The electronic controller 140 may effectuate this movement of the ripper 112 and/or blade 110 back to the desired position via, respectively, signals sent to the ripper positioning system 122 and/or the blade positioning system 114. In some embodiments, this movement of the ripper 112 and/or blade 110 back to the desired position is at a reduced speed. This slow movement of the ripper 112 and/or blade 110 helps ensure that the automatic return does not otherwise interfere with ongoing machine operations or is not overly noticeable to an operator of the machine. In this regard, the slow movement can help reduce jarring of the machine when the work implement reaches an end-of-travel position that may be in contact with the machine frame. In addition, movement of the work implement can lug the engine down, which can reduce the power available for other machine operations. Moving the implement slowly can help minimize any engine lugging that is noticeable to a machine operator or otherwise hampers other machine operations. In some embodiments, the return movement of the work implement is at approximately one-tenth of the full movement speed of the work implement. In other embodiments, the return movement may be slower than one-quarter speed of the work implement. Other return speeds may also be used.

Whether the ripper 112 has returned to the desired position can be determined by the electronic controller 140 via signals from the ripper sensor 142. Likewise, whether the blade 110 has returned to the desired position can be determined by the electronic controller 140 via signals from the blade sensor 144. Once the ripper 112/blade 110 has returned to the desired position, the timer 146 is again initiated to count off the predetermined period of time after which the automatic return function is executed again by the electronic controller 140. This periodic, automatic return function shall continue to be executed by the electronic controller 140 until the operator specifically commands the work implement (e.g., ripper 112 and/or blade 110) to move away from the desired position such as through use of the ripper input device 130 and/or the blade input device 132.

As noted, the timer 146 counts the predetermined amount of time between cycles of the electronic controller 140 executing the automatic return function. According to one embodiment, the predetermined period of time may be a set value (e.g., 10 minutes, 15 minutes, 30 minutes, 45 minutes, 60 minutes, etc.) based, for example, on the type of machine or work environment. In some embodiments, the predetermined period of time may be approximately 30 minutes or less. In other embodiments, the electronic controller 140 may be configured to dynamically determine or adjust the predetermined period of time counted by the timer 146. For example, the controller may determine the predetermined period of time counted by the timer 146 as a function of hydraulic oil temperature in the respective work implement positioning system, i.e. the ripper positioning system 122 and/or the blade positioning system 114. For example, if the hydraulic fluid temperature is relatively higher, the predetermined period of time may be relatively shorter. Conversely, if the hydraulic fluid temperature is relatively lower, the predetermined period of time may be relatively longer. In this instance, hydraulic fluid temperature provides an indication of the viscosity of the hydraulic fluid with a lower temperature indicating a higher viscosity and a higher temperature indicating a lower viscosity. When the viscosity of the hydraulic fluid is relatively higher (i.e., thicker fluid) it will take longer for the work implement to drift out of position and when the hydraulic fluid has a relatively lower viscosity (i.e., thinner fluid) it will take relatively shorter amount of time for the work implement to drift out of position. The hydraulic fluid temperature may be determined, in the illustrated embodiment, by the hydraulic fluid temperature sensor 127 that is in communication with the electronic controller 140. In other embodiments, the viscosity of the hydraulic fluid may be determined using something other than temperature.

Additionally, in some embodiments, the electronic controller 140 may be configured to, over time, learn how much the work implement drifts and adjust its operating parameters to optimize how often or how much the work implement needs to be moved to maintain the desired position. This will limit the impact on machine performance when the work implement is being returned to the desired position. For example, the electronic controller 140 may determine the predetermined period of time based on an amount of time it takes for the automatic return function to be completed. Generally, the automatic return can be completed in only a few seconds. When the work implement has drifted farther from the desired position, it necessarily takes the electronic controller 140 relatively longer to complete the automatic return function. In such circumstances, the electronic controller 140 could be configured to reduce the predetermined period of time counted by the timer 146 so that the automatic return function is performed more frequently. Conversely, if the electronic controller 140 performs the automatic return function more quickly, it can indicate that the work implement has not drifted very far and the electronic controller 140 may lengthen the predetermined period of time between cycles. Additionally, if the time required to return the work implement to the desired position is beyond an expected amount, the electronic controller 140 can be configured to alert the operator, such as via an alert in the operator station 128, that service may be required. More broadly, the electronic controller 140 may be configured to monitor the amount of movement required to return the work implement to desired position and provide the service signal if the amount of movement exceeds a predetermined threshold representing, for example, an expected amount of movement. The extra movement required to return the work implement may be a sign of a maintenance issue in, for example, the hydraulic system or more broadly in the work implement positioning system that is causing more drift of the work implement out of the desired position than typically occurs during normal machine operations. The electronic controller 140 may monitor the amount of movement required to return the work implement to the desired position via any suitable method including, for example, one or more position sensors that measure the current position of the work implement at the time the auto return function is initiated or that measure the distance the work implement moves during the auto return function or a timer that measures the amount of time required for the work implement to move back to the desired position as the amount of time required to perform the auto-return function can be indicative of the amount of movement required.

INDUSTRIAL APPLICABILITY

The present disclosure is applicable to any type of machine which includes a work implement. The present disclosure is particularly applicable to work implements that may be placed in a particular position, such as an end-of-travel position (e.g., fully raised or fully closed) during certain machine operations that do not involve the use of the work implement. In such circumstances, the unused work implement can drift out of the desired position. The control system and method of the present disclosure eliminates the need for the machine operator to actively monitor and adjust for such drift by periodically returning the work implement to the desired position automatically without any operator intervention.

Figure 3:
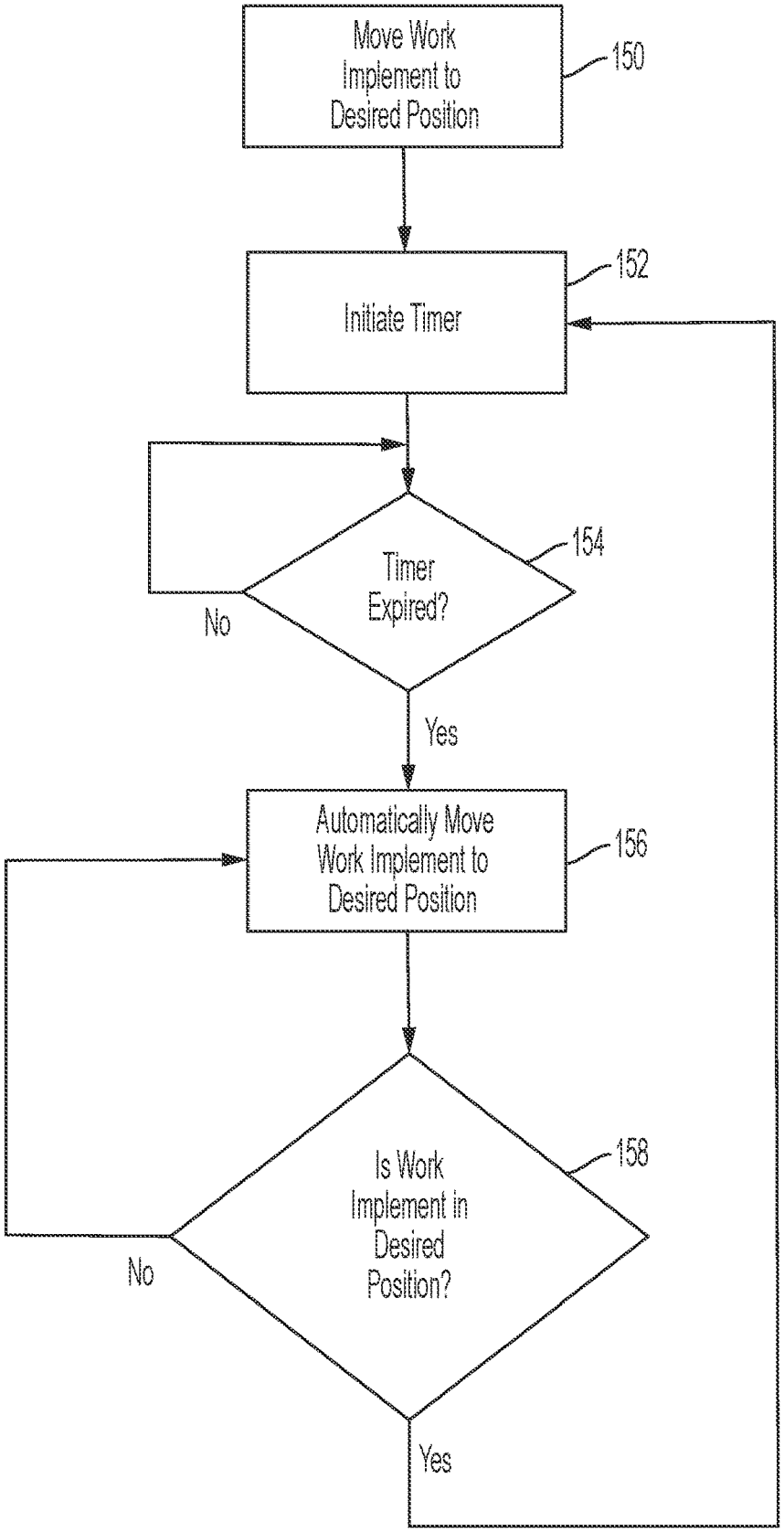
FIG. 3 is a flow chart illustrating an exemplary process that is executable by the work implement control system of FIG. 2.

Referring to FIG. 3, and in general accordance with the prior figures, there is illustrated an exemplary process for controlling the position of a work implement (such as ripper 112 or blade 110) that may be executed by the electronic controller 140. The process depicted in the flow diagram of FIG. 3 for accomplishing these tasks may include a series of steps or instruction implemented as non-transitory computer executable software code in the form of an application or program that is run by the electronic controller 140. In step 150 of the process, the work implement is moved to a desired position. The movement of the work implement to the desired position may be done by the operator through operation of the ripper input device 130 if the implement is the ripper 112 or the blade input device 130 if the implement is the blade. Once the work implement is in the desired position, the electronic controller 140 may initiate the timer 146 in step 152.

In step 154, it is determined if the timer has expired through passage of the predetermined amount of time. If the timer 146 has not expired, step 154 is repeated until the timer 146 has expired. Once the timer 146 has expired, the process proceeds to step 156 where the electronic controller 140 automatically returns the work implement from the current position to the desired position into which the work implement was originally placed in step 150. The movement back to the desired position in step 156 compensates for any drift of the work implement that may have occurred while the timer 146 is running. The movement of step 156 can be implemented by the controller directing the associated positioning mechanism for the work implement such as the ripper positioning system 122 and/or the blade positioning system 114.

In step 158, it is determined if the work implement has reached the desired position. This can be done by the electronic controller 140 through use of one or more sensors, such as the ripper sensor 142 and/or the blade sensor 144. If the work implement has not reached the desired position, the electronic controller continues to move the work implement by repeating step 156. If the work implement has reached the desired position, the process returns to step 152 and the timer 146 is again initiated by the electronic controller 140. As previously noted, the process may be repeated until an operator specifically commands the work implement (e.g., ripper 112 and/or blade 110) to move away from the desired position such as through use of the ripper input device 130 and/or the blade input device 132.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or "one or more of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A control system for controlling a position of a work implement, the control system comprising:

a work implement positioning system that is configured to be operated for moving the work implement;

a sensor associated with the work implement and configured to obtain position information of the work implement; and a controller configured to:

determine, based on the position information, that the work implement is at a desired position;

initiate, in response to determining that the work implement is at the desired position, a timer that is configured to indicate when a predetermined period of time has elapsed, wherein drifting of the work implement, away from the desired position to a current position, occurs without operation of the work implement positioning system;

cause, automatically and without operator intervention, based on the timer indicating that the predetermined period of time has elapsed, the work implement positioning system to be operated to return the work implement from the current position to the desired position; and determine, based on the position information of the work implement, that the work implement has returned to the desired position.

2. The control system of claim 1, wherein, based on determining that the work implement has returned to the desired position, the controller is further configured to:

re-initiate the timer; and cause, based on the timer, after being re-initiated, indicating that the predetermined period of time has elapsed, the work implement positioning system to be operated to return the work implement to the desired position.

3. The control system of claim 1, wherein the controller is configured to repeat initiating the timer and causing the work implement positioning system to be operated to return the work implement to the desired position until an operator commands the work implement to move away from the desired position through a work implement input device.

4. The control system of claim 1, wherein the desired position is a travel position or an idle position of the work implement.

5. The control system of claim 1, wherein the controller is configured to provide a service alert based on an actual amount of movement to return the work implement from the current position to the desired position exceeding a predetermined threshold.

6. The control system of claim 1, wherein the work implement positioning system includes:

at least one hydraulic actuator powered by a hydraulic system containing hydraulic fluid; and a hydraulic temperature sensor in communication with the controller and configured to indicate a temperature of the hydraulic fluid.

7. The control system of claim 6, wherein the controller is configured to adjust the predetermined period of time based the temperature of the hydraulic fluid.

8. The control system of claim 1, wherein the controller is configured to adjust the predetermined period of time based on an operating time of the work implement positioning system to return the work implement from the current position to the desired position.

9. A machine comprising:

a machine frame;

a work implement supported on the machine frame;

a work implement positioning system for moving the work implement to a desired position;

a sensor associated with the work implement and configured to obtain position information of the work implement; and a controller configured to:

determine, based on the position information, that the work implement is at the desired position;

initiate, in response to determining that the work implement is at the desired position, a timer that is configured to indicate when a predetermined period of time has elapsed, wherein drifting of the work implement, away from the desired position to a current position, occurs without operation of the work implement positioning system;

cause, automatically and without operator intervention, based on the timer indicating that the predetermined period of time has elapsed, the work implement positioning system to be operated to return the work implement from the current position to the desired position; and determine, based on the position information of the work implement, that the work implement has returned to the desired position.

10. The machine of claim 9, wherein, based on determining that the work implement has returned to the desired position, the controller is further configured to:

re-initiate the timer; and cause, based on the timer, after being re-initiated, indicating that the predetermined period of time has elapsed, the work implement positioning system to be operated to return the work implement to the desired position.

11. The machine of claim 10, wherein the controller is configured to repeat initiating the timer and causing the work implement positioning system to be operated to return the work implement to the desired position until an operator commands the work implement to move away from the desired position through a work implement input device.

12. The machine of claim 9, wherein the desired position is a travel position or an idle position of the work implement.

13. The machine of claim 9, wherein the controller is configured to provide a service alert based on an actual amount of movement to return the work implement from the current position to the desired position exceeding a predetermined threshold.

14. The machine of claim 9, wherein the work implement positioning system includes:

at least one hydraulic actuator powered by a hydraulic system containing hydraulic fluid; and a hydraulic temperature sensor in communication with the controller and configured to indicate a temperature of the hydraulic fluid.

15. The machine of claim 14, wherein the controller is configured to adjust the predetermined period of time based the temperature of the hydraulic fluid.

16. The machine of claim 9, wherein the controller is configured to adjust the predetermined period of time based on an operating time of the work implement positioning system to return the work implement from the current position to the desired position.

17. A method for controlling movement of a work implement to a desired position, the method comprising:

placing the work implement in the desired position using a work implement positioning system;

initiating, in response to the work implement being placed in the desired position, a timer that is configured to indicate when a predetermined period of time has elapsed;

wherein drifting of the work implement, away from the desired position to a current position, occurs without operation of the work implement positioning system;

causing, automatically and without operator intervention, based on the timer indicating that the predetermined period of time has elapsed, the work implement to be moved from the current position to the desired position;

re-initiating the timer upon determining that the work implement has returned to the desired position; and causing, based on the timer, after being re-initiated, indicating that the predetermined period of time has elapsed, the work implement to return to the desired position.

18. The method of claim 17, further including providing a service alert based on an amount of movement to return the work implement from the current position to the desired position exceeding a predetermined threshold.

19. The method of claim 17, further including adjusting the predetermined period of time based a hydraulic fluid temperature.

20. The method of claim 17, further including adjusting the predetermined period of time based on an operating time to return the work implement from the current position to the desired position.

* * * * *